US005802823A

United States Patent [19]

Woods

[11] Patent Number: 5,802,823

[45] Date of Patent: Sep. 8, 1998

[54] SHOCK ABSORBING PANEL ASSEMBLY FOR SADDLES

[76] Inventor: John P. Woods, P.O.Box 2666, El Cajon, Calif. 92021

[21] Appl. No.: 708,255

[22] Filed: Sep. 6, 1996

[51] Int. Cl.[6] ..... B68C 1/12

[52] U.S. Cl. ..... 54/66

[58] Field of Search ..... 54/44.5, 65, 66

[56] References Cited

U.S. PATENT DOCUMENTS

| | | | |
|---|---|---|---|
| 184,975 | 12/1876 | McCormick | 54/66 |
| 4,324,090 | 4/1982 | Nix | 54/44.5 |
| 4,683,709 | 8/1987 | Vasko et al. | 54/66 |
| 4,745,734 | 5/1988 | Brown . | |
| 5,027,589 | 7/1991 | Gleb et al. | 54/66 |
| 5,119,618 | 6/1992 | Streck | 54/66 |
| 5,299,412 | 4/1994 | Cudney et al. | 54/66 |
| 5,575,139 | 11/1996 | Green | 54/66 |

*Primary Examiner*—Robert P. Swiatek

*Attorney, Agent, or Firm*—Brown, Martin, Haller & McClain, LLP

[57] ABSTRACT

A shock absorbing panel assembly for positioning beneath a saddle includes right- and left-hand panels for positioning in pockets in a saddle pad or blanket on the right- and left-hand side of a horse's back. Each panel is of multi-layer construction and includes a base with at least one layer of foam or other cushioning material and one layer of non-cushioning material. The base has at least two recesses and a shock absorbing pad is mounted in each recess to project out of the recess. Each pad also has two layers of cushioning material with an intervening layer of non-cushioning material.

18 Claims, 3 Drawing Sheets

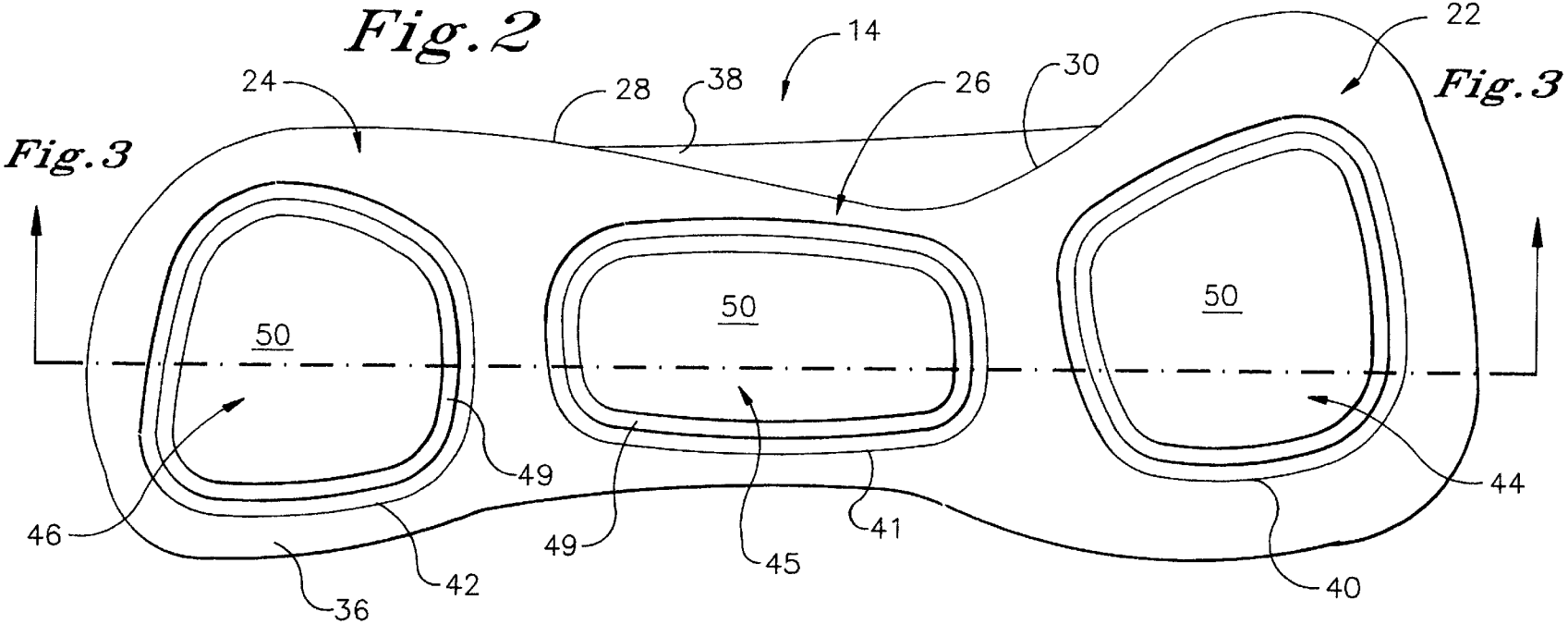
Fig. 3
22
44
40
50
30
26
14
38
28
41
45
49
24
42
36
46
Fig. 3
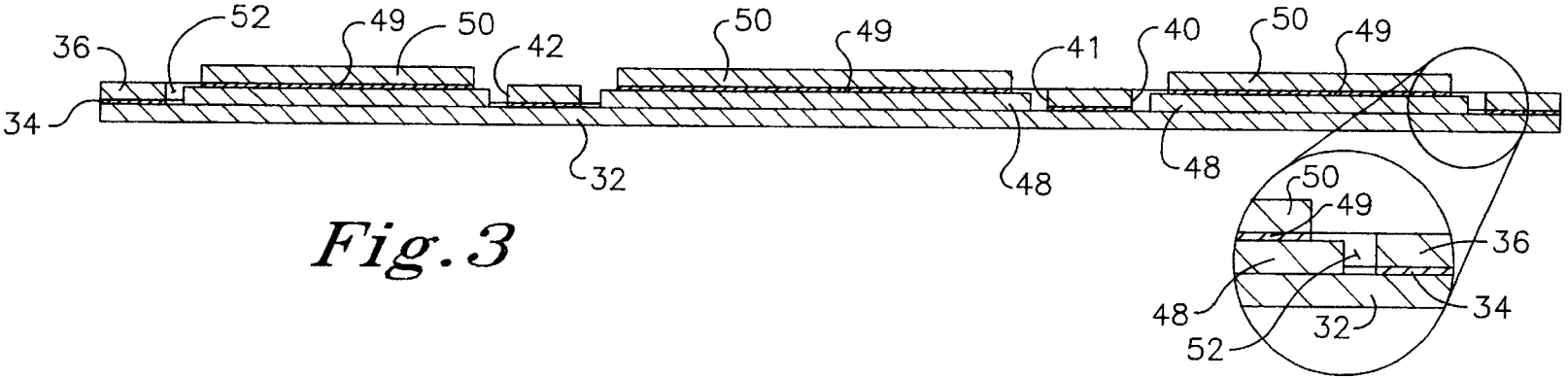
36
34
49
50
32
52
48
40
41
42
Fig. 3

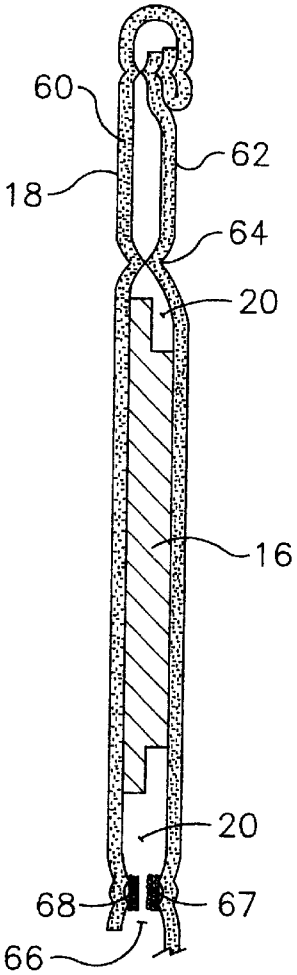
Fig. 5
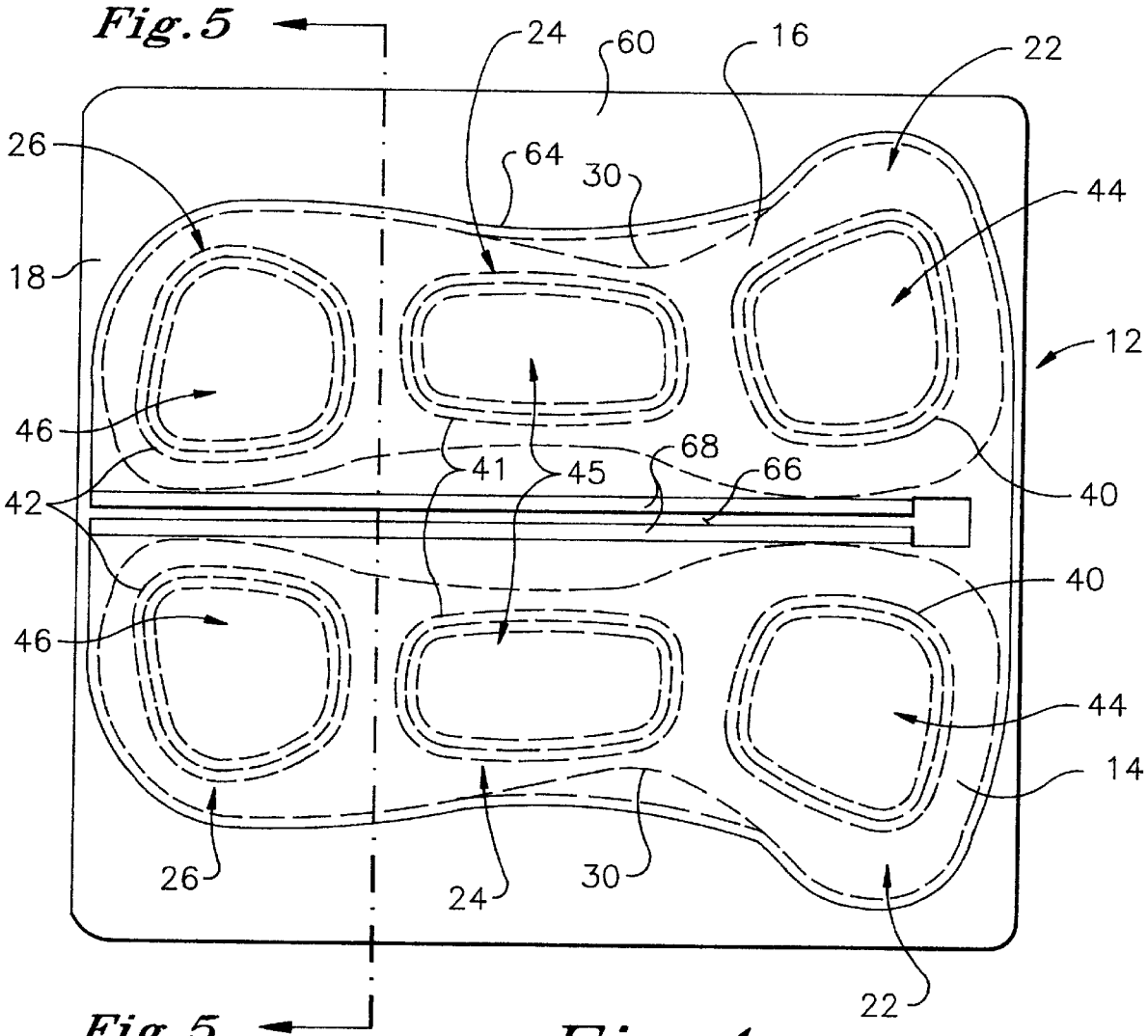
Fig. 4
Fig. 5
Fig. 5

SHOCK ABSORBING PANEL ASSEMBLY FOR SADDLES

BACKGROUND OF THE INVENTION

The present invention relates generally to riding saddles, particularly for horse riding, and is particularly concerned with a shock absorbing arrangement for such saddles.

Known riding saddles concentrate the rider's weight at the points of contact between the saddle and the horse's back. Saddles do not readily conform to the precise shape of the horse's back, and thus contact between the saddle and horse's back may occur only at relatively few points. Excessive pressure at these points can cause bruising and considerable discomfort to the horse.

Some prior art arrangements have attempted to reduce or solve this problem. Saddle pads with foam cores or inserts are commonly used beneath saddles to prevent chafing. Such an arrangement is described in U.S. Pat. No. 5,027,589 of Gleb et al., for example. However, the foam in such pads becomes crushed and ineffective after repeated use. In U.S. Pat. No. 4,745,734 of Brown, a pair of flexible skirts are permanently attached to the underside of the saddle so that the skirts contact the horse's back and provide a larger surface area of contact between the saddle and horse. The skirts also conform to the contours of the horse's back and to changes in the contours as the horse moves.

SUMMARY OF THE INVENTION

It is an object of the present invention to provide a new and improved shock absorbing panel assembly for mounting beneath a riding saddle.

According to one aspect of the present invention, a shock absorbing panel is provided which comprises an elongate member having enlarged forward and rearward ends and a thinner central region, the elongate member having a first layer of cushioning material, a second layer of a non-cushioning material having at least two openings, a first opening being located at the forward end region and a second opening being located at the rearward end region, and a shock absorbing pad mounted in each of the openings and projecting outwardly from the openings.

Preferably, two different panels are provided, the first one having a perimeter shaped for mounting on the left-hand side of a horse's back beneath the saddle, and the second one having a perimeter shaped for mounting on the right-hand side of the horse's back, with the second panel being a mirror image of the first. In a preferred embodiment, each panel has a second layer with three openings, and a shock absorbing pad is mounted in each of the openings. Each shock absorbing pad is preferably of multi-layer construction, having at least two foam layers and an intermediate resilient, non-cushioning layer. Additionally, the elongate member has a third layer of cushioning material overlying the second layer, and the openings extend through both the second and third layers. The first and third layers are preferably of foam material, while the second layer is preferably of resilient plastic material. With this arrangement, each of the shock absorbing pads can compress independently to absorb shock in that region, while weight is distributed over the entire area of-the panel. The panel conforms to the shape of both the overlying saddle and the underlying back of the horse. This reduces shock and impact on the horse's back as the rider bounces in the saddle, for example, and will therefore reduce bruising and pain.

According to another aspect of the present invention, a shock absorbing pad assembly is provided, which comprises a saddle pad member for placing beneath a saddle to extend across the area of a horse's back covered by the saddle, the pad member having pockets for positioning on opposite sides of a horse's back, and a pair of shock absorbing right- and left-hand panels for fitting in the respective pockets. Each panel has an enlarged forward end portion and a rear end portion connected by a narrower central portion, and is of multi-layer construction. The panel comprises a base having at least two recesses in one face, and a shock absorbing pad mounted in each recess so as to project upwardly out of the recess. The panels may be permanently or removably mounted in the blanket with the shock absorbing pads facing upwardly towards the saddle. The base preferably comprises a first cushioning layer, a second layer of different material from the first, and a third cushioning layer, with the recesses comprising openings extending through the second and third layers. The shock absorbing pads are preferably also of multi-layer construction, including at least two foam layers with an intervening layer of resilient, non-foam material.

Three openings or recesses may be provided in each panel, with a shock absorbing pad in each recess, a first pad being located at the forward end of the panel, a second pad being located in a central region, and a third pad being located at the rear end portion of the panel. The pads are located at the main pressure points typically resulting from-riding. The first shock absorbing pad is positioned for extending over the sides of the withers and shoulders, where the majority of saddle pressure is concentrated. The second shock absorbing pad is positioned beneath the location of a rider's legs, and the third shock absorbing pad is positioned to the rear of the horse's back at the other common pressure region caused by saddle use.

When a saddle is placed over the saddle pad, the panels will act to cushion the horse's back against shocks and to distribute the rider's weight more evenly over the back. The panels will conform to the shape of the horse's back and the lower face of the saddle. The pad layers are secured together by adhesives, avoiding the need for any rivets or other mechanical fasteners which may cause discomfort. The three separate shock absorbing pads act independently to absorb shocks and reduce stress in the appropriate regions, and distribute weight more evenly over the horse's back rather than concentrating it in certain areas. The pads can be readily removed for washing or replacement as needed. The pad assembly will considerably reduce discomfort to the horse on long riding trips.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which:

FIG. 2 is a bottom plan view of a right-hand panel of the pad assembly;

FIG. 3 is a section on the lines 3—3 of FIG. 2 schematically illustrating a saddle pad pocket in which the panel is installed;

FIG. 4 is a top plan view of the saddle pad assembly; and

FIG. 5 is a section on the lines 5—5 of FIG. 4.

DESCRIPTION OF THE PREFERRED EMBODIMENT

Figure 1:
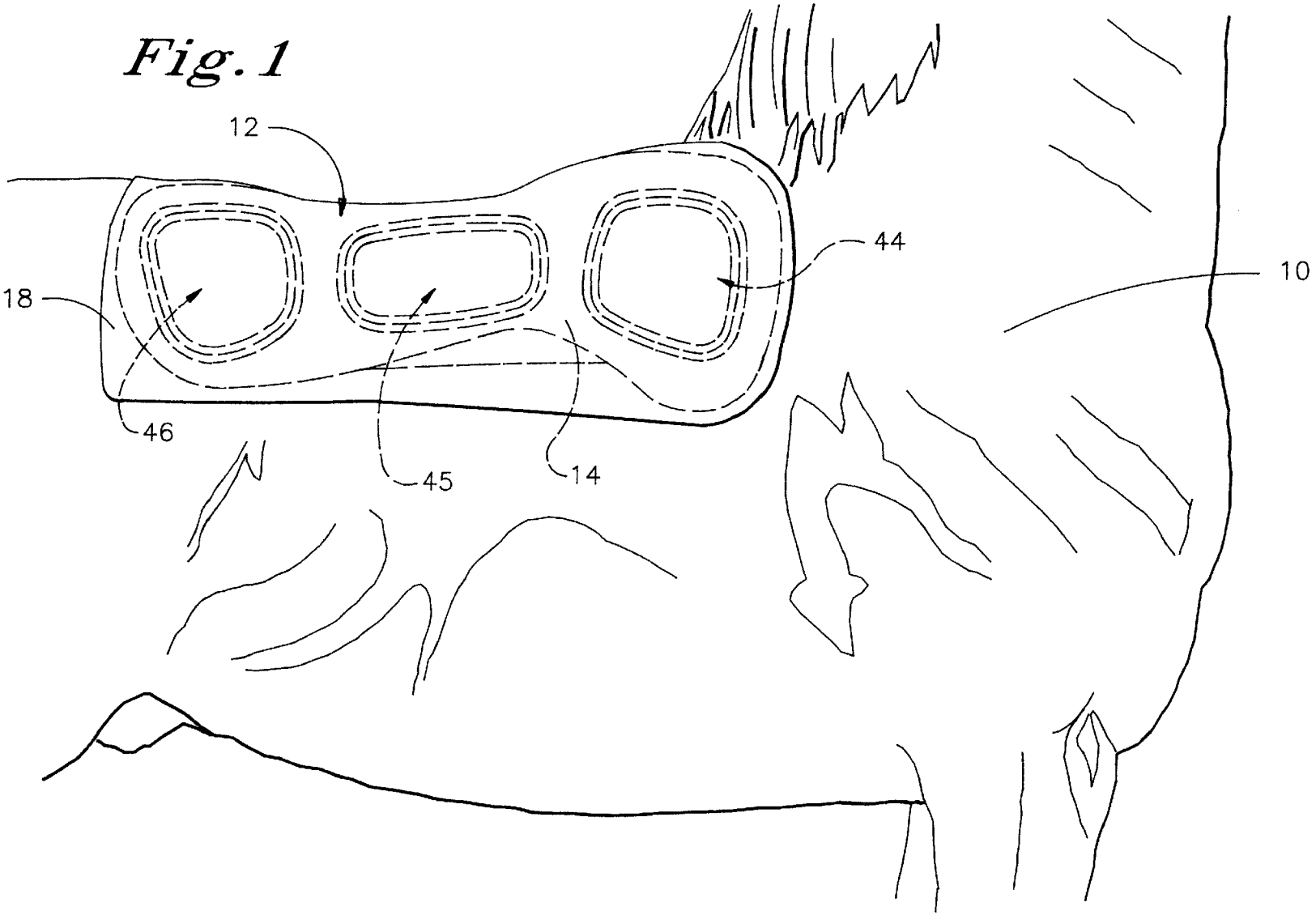
FIG. 1 is a side view of part of the back of a horse, illustrating the position of a saddle pad assembly according to a preferred embodiment of the present invention.

FIG. 1 of the drawings illustrates the right-hand side of a horse 10 with a shock absorbing panel assembly 12 according to a preferred embodiment of the invention positioned on the horse's back prior to placing a saddle over the panel assembly. Only the right-hand side of the panel assembly is visible in FIG. 1, but FIG. 4 illustrates the entire panel assembly laid flat prior to placing on the horse's back, while FIGS. 2 and 3 illustrate one of the shock absorbing panels of the assembly in more detail.

The panel assembly basically comprises a pair of shock absorbing panels 14,16 for positioning on the right- and left-hand side, respectively, of a horse's back, and a saddle pad or blanket 18 having suitable pockets 20 sewn in for receiving the panels. As best illustrated in FIGS. 4 and 5, the pad or blanket 18 is preferably of two layer construction, having an outer layer 60 of suitable hard-wearing fabric or canvas, and an inner layer 62 which may be of sheepskin or other soft material for placing against the horse's back. The outer and inner layers are sewn together around their peripheral edges, and are also sewn together along lines 64 to form the pockets 20. An access opening 66 is provided along the inner edge of each pocket, and the opening 66 is releasably closed by means of opposing strips 67, 68 of hook and loop type fastener material. Thus, the panels can be inserted into the respective pockets via openings 66, and can be readily removed as needed for cleaning or replacement. Alternatively, the panels may be permanently sewn in position.

FIGS. 2 and 3 illustrate the panel 14 for positioning over the right-hand side of a horse's back in more detail. The left-hand panel 16, illustrated in FIG. 4, is of equivalent structure and like reference numerals have been used for like parts as appropriate. However, left-hand panel 16 is constructed as a mirror image to the outer periphery of panel 14, as can be seen in FIG. 4, so that it conforms to the left-hand side of a horse's back. Each of the panels is an elongate member having an enlarged forward end portion 22 and rear end portion 24, and a narrower central portion 26. The outer side edge 28 of the panel is relieved adjacent the forward end portion to form an inwardly curved region 30 corresponding to the position of a rider's leg when the panel assembly is in use, as will be described in more detail below.

Each panel is of multi-layer construction, with layers of open cell foam material interleaved with layers of flexible plastic sheet material, and the layers are secured together by means of a suitable adhesive. Each panel has a first layer 32 of foam material, a second layer 34 of plastic material, and a third layer 36 of foam material all having substantially matching peripheral edges, apart from a wider portion 38 at the outer side edge of the first or outer layer 32. Three openings or cut outs 40, 41 and 42, respectively, are formed through the second and third layers at the front end, center and rear end portions, respectively, of the panel. A shock absorbing, multi-layer pad 44, 45 and 46, respectively, is secured in each of the first, second and third opening, 40, 41, 42, respectively, so as to project partially out of the respective opening, as best illustrated in FIG. 3. Each pad has a first layer 48 of foam material, a second layer 49 of flexible plastic sheet material, and a third layer 50 of foam material. The first layer 48 of each pad is of slightly larger dimensions than the other two layers, and of slightly smaller dimensions than the respective opening, so that there is a clearance 52 between each pad and the side of the opening. The pad layers are secured together, and to the outer layer 32 at the base of each opening, by means of a suitable adhesive. Any suitable open cell foam material may be used for each of the foam layers, such as Uniroyal Ensolite 0.125, 0.250 or 0.375, or equivalent material. The plastic sheet material of layers 34 and 49 may be ABS plastics 0.063 or 0.093 or equivalent materials. By using open cell foam, breathability and moisture flow is permitted, so that less heat will build up beneath the pad assembly.

As described above, the two panels are designed to be placed into pockets 20 in saddle pad or blanket 18, as illustrated in FIGS. 4 and 5, with the two outer edges 28 positioned on the outside and the three shock absorbing pads 44, 45 and 46 facing upwardly towards the saddle. A saddle is then placed over saddle pad or blanket 18. The openings 40, 41 and 42 are of suitable shape, dimensions and position so as to extend over the major pressure areas on a horse's back resulting from prolonged periods of riding. Thus, the front opening 40 is designed to lie over the withers or forward portion of the horse's back, since saddles are normally designed to concentrate more weight over this region, above the horse's front legs. The central opening 41 corresponds to the region over which the rider's leg will normally extend, and the rear opening 42 is located over a rear portion of the side of the horse's back, as generally illustrated in FIG. 1, where the rider is normally seated.

The shock absorbing pads 44, 45 and 46 are therefore ideally positioned to absorb shocks and cushion the horse's back. The foam material will readily conform to the contours of the horse's back, while the intervening plastic layers will prevent or reduce crushing of the foam to the extent that it no longer cushions. The multi-layer construction therefore provides much better cushioning capabilities than a single layer of foam of equivalent thickness. The clearance around each of the shock absorbing pads or panels in the openings provides a path for air and moisture flow through the panels, enhancing breathability and reducing heat buildup. The twelve separate layers of the panel and pads combine to produce much better weight distribution, cushioning and shock absorption than in previous cushion pads, and the panel is more able to conform to the contours of the horse and saddle than with previous designs.

The dimensions of the panel and pads are selected based on the average dimensions of a horse and saddle, so that the two panels will cover the regions of the horse's back which are normally subject to pressure with saddle use. The length of each panel is around 20 to 24 inches, while the width across the widest portion at the front end of the panel is around 9 inches. The width across rear end portion 24 is around 6 to 8 inches, and the width across the narrowest portion at the center of the panel is around 4 to 5 inches. The shape and dimensions of the panels may be varied to correspond to areas covered by different types of saddles, such as English and Western style.

The front end opening 40 is the largest of the three panel openings or cut outs, and is around 7 inches long and 6 inches across the widest part of the opening. It is of generally rounded shape but wider across the forward end than the rear end. The pad 44 is dimensioned to fit within opening 40 with a gap of width around 0.25 to 0.5 inches between the edge of the opening and the outer edge of the pad. The central opening 41 is the smallest, and is of elongated, generally rectangular shape but with rounded corners and slightly curved peripheral edges. Opening 41 has a length of around 6.5 to 7.5 inches and a width of around 2.5 to 3.5 inches. Again, the pad 45 is dimensioned to fit within opening 41 with a clearance or gap of the same width as the pad 44. The rear opening is of a more rounded shape, and has a length of the order of 5 inches and a varying width in the range from around 4 to 5 inches. The pad 46 is dimensioned to fit within rear opening 42 with the same clearance between the edge of the pad and the edge of the opening as with the other two pads and openings. Each of the foam layers is of approximately the same thickness, and the plastic layers are thinner than the foam layers. Preferably, the foam layers each have a thickness between 0.125 to 0.375 inches, and the plastic layers each have a thickness in the range from 0.06 to 0.10 inches.

The shock absorbing panel assembly can be mounted in a saddle pad or blanket as in FIG. 4 and readily positioned over a horse's back prior to positioning the saddle on top. Since the panel assembly is not permanently secured to the saddle, it can be readily cleaned or replaced as necessary. The relieved side edge region 28 of each panel will relieve weight from a rider's leg on the horse's back, and is positioned to correspond to the normal location where the rider's leg will pass over the edge of the saddle to extend into the stirrup. The multi-layer construction with separate shock absorbing panels over each of the areas most subject to soreness or bruising will significantly increase comfort and reduce the risk of injury to the horse. The open cell foam layers will absorb shock, distribute weight more evenly, cushion and conform to the horse's back, and have a spring-like action to reduce impact. The use of twelve different layers in each panel has been found to produce significantly enhanced cushioning, shock absorption and weight distribution and reduction of stress and trauma to the horse's back and shoulders.

Although a preferred embodiment of the invention has been described above by way of example only, it will be understood by those skilled in the field that modifications may be made to the disclosed embodiment without departing from the scope of the invention, which is defined by the appended claims.

I claim:

1. A shock absorbing panel assembly for positioning on a horse's back beneath a saddle, comprising:

a saddle pad for placing beneath a saddle on a horse's back, the saddle pad having a right-hand side pocket and a left-hand side pocket;

a right-hand panel member positioned in the right-hand side pocket and a left-hand panel member positioned in the left-hand side pocket so as to extend over right- and left-hand regions, respectively, of a horse's back;

each panel member having an enlarged forward end portion, a central portion, and a rear end portion;

each panel member comprising a base having at least two recesses in one face, and a shock absorbing pad mounted in each of the recesses and projecting outwardly from the recess; and the base comprising at least one layer of cushioning material.

2. The panel assembly as claimed in claim 1, wherein the base further comprises a second layer of non-cushioning material and a third layer of cushioning material extending over the second layer, and the recesses each comprise an opening extending through the second and third layers only of the base.

3. The panel assembly as claimed in claim 1, wherein the cushioning material is open cell foam material.

4. The panel assembly as claimed in claim 1, wherein the non-cushioning material is flexible plastic sheet material.

5. The panel assembly as claimed in claim 1, wherein each recess has a peripheral edge of predetermined shape and dimensions and the respective shock absorbing pad is of corresponding shape and smaller dimensions so as to provide a gap between the pad and the peripheral edge of the respective recess.

6. The panel assembly as claimed in claim 1, wherein each shock absorbing pad is of multi-layer construction and includes a first layer of cushioning material, a second layer of non-cushioning material, and a third layer of cushioning material.

7. The panel assembly as claimed in claim 6, wherein each of the cushioning material layers of the base and shock absorbing pads is of open cell foam material.

8. The panel assembly as claimed in claim 7, wherein the non-cushioning material layer of the shock absorbing pads is of flexible plastic sheet material.

9. The panel assembly as claimed in claim 1, wherein a first recess is provided in the forward end portion of each panel member, a second recess is provided in the central portion, and a third recess is provided in the rear end portion, and first, second and third shock absorbing pads are secured in the first, second and third recesses, respectively.

10. The panel assembly as claimed in claim 9, wherein each shock absorbing pad has two layers of cushioning material and an intermediate layer of non-cushioning material between each of the cushioning layers.

11. The panel assembly as claimed in claim 10, wherein the cushioning layers are of substantially equal thickness and are thicker than the non-cushioning layer.

12. The panel assembly as claimed in claim 10, wherein the panel members and pad layers are secured together by adhesive.

13. The panel assembly as claimed in claim 9, wherein each shock absorbing pad is of smaller dimensions than the shock absorbing respective recess to leave a gap between the shock absorbing pad and the outer periphery of the recess.

14. A shock absorbing panel for placing between one side of a horse's back and a saddle, the panel comprising:

an elongate member having an enlarged forward end portion, a central portion, and a rear end portion, the member being of predetermined shape and dimensions for extending over a substantial portion of one side of a horse's back which is normally covered by a saddle;

the elongate member having a first layer of cushioning material and a second layer of non-cushioning material having at least two openings; and a shock absorbing pad mounted in each of the openings and secured to the first layer, the pads projecting out of the respective openings.

15. The panel as claimed in claim 14, including a third layer of cushioning material extending over the second layer, the openings extending through the second and third layers.

16. The panel as claimed in claim 15, wherein there are three openings extending through the second and third layers, comprising a first opening in the forward end portion of the elongate member, a second opening in the central portion, and a third opening in the rear end portion and first, second and third shock absorbing pads mounted in the first, second and third openings, respectively.

17. The panel as claimed in claim 16, wherein each of the shock absorbing pads has a two outer layers of cushioning material and an intermediate layer of non-cushioning material between the outer layers.

18. The panel as claimed in claim 14, wherein the elongate member has an outer side edge with an inwardly curved region at a predetermined position corresponding to the location of a rider's leg when the panel is positioned on a horse's back.

* * * * *